US011420222B2

(12) United States Patent
Hirano et al.

(10) Patent No.: US 11,420,222 B2
(45) Date of Patent: Aug. 23, 2022

(54) VEHICLE PAINTING METHOD AND PAINTING SYSTEM

(71) Applicant: TOYOTA JIDOSHA KABUSHIKI KAISHA, Toyota (JP)

(72) Inventors: Yuichi Hirano, Nagoya (JP); Yohei Sano, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 91 days.

(21) Appl. No.: 16/512,742

(22) Filed: Jul. 16, 2019

(65) Prior Publication Data

US 2020/0078809 A1 Mar. 12, 2020

(30) Foreign Application Priority Data

Sep. 7, 2018 (JP) ..... JP2018-167837

(51) Int. Cl.
*B05B 12/12* (2006.01)
*B05D 7/14* (2006.01)
*B05D 1/02* (2006.01)

(52) U.S. Cl.
CPC ..... *B05B 12/12* (2013.01); *B05D 1/02* (2013.01); *B05D 7/14* (2013.01)

(58) Field of Classification Search
CPC ..... B05D 7/14
See application file for complete search history.

(56) References Cited

U.S. PATENT DOCUMENTS

2008/0176079 A1* 7/2008 Elia ..... B29C 45/14778 428/411.1

FOREIGN PATENT DOCUMENTS

| | | |
|---|---|---|
| JP | 2-107369 | 4/1990 |
| JP | 6-142565 | 5/1994 |
| JP | 2008-023454 A | 2/2008 |

* cited by examiner

*Primary Examiner* — Nathan T Leong
(74) *Attorney, Agent, or Firm* — Oblon, McClelland, Maier & Neustadt, L.L.P.

(57) ABSTRACT

A method of painting a vehicle according to an embodiment including a first member and a second member which includes a painting surface and which is made of a material different from that of the first member. The method includes acquiring an environmental condition and a painting condition when the first member has been painted, and determining an environmental condition and a painting condition for the second member, which are determined in advance so that a color of the second member and a color of the first member will have a sameness in view of the acquired environmental condition and painting condition for the first member, as the environmental condition and the painting condition at the time of painting the second member which may be used together with the first member.

10 Claims, 7 Drawing Sheets

| | | |
|---|---|---|
| EXPLANATORY VARIABLE | ENVIRONMENTAL CONDITION (ENVIRONMENTAL TEMPERATURE) | AMBIENT TEMPERATURE AND HUMIDITY |
| | | BOOTH TEMPERATURE AND HUMIDITY |
| | | MEMBER TEMPERATURE |
| | PAINTING CONDITION | PAINT TEMPERATURE |
| | | S/A FLOW RATE |
| | | BELL CUP ROTATION SPEED |
| | | PAINT CURRENT VALUE |
| | | PAINT DISCHARGE AMOUNT |
| | | ROBOT T VALUE |
| OBJECTIVE VARIABLE | COLOR DIFFERENCE | Lab VALUE |
| | | MEASUREMENT ANGLE |

Fig. 4

VEHICLE PAINTING METHOD AND PAINTING SYSTEM

CROSS REFERENCE TO RELATED APPLICATIONS

This application is based upon and claims the benefit of priority from Japanese patent application No. 2018-167837, filed on Sep. 7, 2018, the disclosure of which is incorporated herein in its entirety by reference.

BACKGROUND

The present disclosure relates to a painting method and a painting system for vehicles. The present disclosure relates to, for example, a painting method and a painting system for vehicles to paint respective members of a vehicle including a steel plate such as a body and a resin member such as a bumper.

Japanese Unexamined Patent Application Publication No. H06-142565 discloses a technique of storing painting conditions and painting defects for each vehicle and working out measures to reduce the painting defects for different painting booths, vehicle models, and paint colors.

SUMMARY

Even in a single vehicle, the color after painting, i.e., the color after it has painted and then dried may differ between members thereof made of different materials such as a body and a bumper. It is thus difficult to work out measures to reduce the color difference that occurs between the members of the single vehicle. A possible method for reducing the color difference may be to keep the painting booths and the like at a constant temperature at all times. However, such a method requires a large amount of energy to keep the painting booths and the like at the constant temperature. For this reason, it is desirable to reduce the color difference between different members in a manner which consumes less energy.

The present disclosure has been made to solve such a problem. The present disclosure provides a painting method and a painting system for vehicles capable of reducing a color difference between different members in a manner which consumes less energy.

An example aspect of the present disclosure is method of painting a vehicle including a first member and a second member which includes a painting surface and which is made of a material different from that of the first member. The method includes: acquiring an environmental condition and a painting condition when the first member has been painted; and determining an environmental condition and a painting condition for the second member, which are determined in advance so that a color of the second member and a color of the first member will have a sameness in view of the acquired environmental condition and painting condition for the first member, as the environmental condition and the painting condition at the time of painting the second member which may be used together with the first member. With such a configuration, the environment condition and the painting condition of one of the members are determined based on the environmental condition and the painting condition for the other one of the members determined in advance so that the color of the one of the members and that of the other one of the members will have the sameness. By doing so, the adjustment of the environmental conditions and the painting conditions is needed for only one of the members, which reduces the energy consumption.

Further, when a difference between the color of the first member after the painting and the color of the second member after the painting falls within a predetermined range, the environmental condition and the painting condition at the time of painting the first member are stored in association with the environmental condition and the painting condition at the time of painting the second member. The environmental condition and the painting condition at the time of painting the second member are determined based on the stored environmental condition and the painting condition. With such a configuration, since the determination is made based on the previously stored environmental condition and the painting condition, it is possible to select the condition which causes the smallest color difference.

Further, the first member is a steel plate, the second member is a resin member, the environmental condition at the time of painting the first member includes a temperature of a steel plate painting booth where the steel plate is painted, and the environmental condition at the time of painting the second member includes a temperature of a resin member painting booth where the resin member is painted. With such a configuration, the energy to adjust the painting condition of the booth where small parts such as a bumper are painted is smaller than the energy to adjust the painting condition of the booth where large parts such as a body are painted. Thus, it is possible to reduce the color difference between different members in a manner which consumes less energy.

The environmental condition includes an ambient temperature outside a factory where the resin member painting booth is provided. The temperature of the booth largely influences the color after the painting. The temperature of the booth can be predicted from the ambient temperature. This enables control on the painting condition including a temperature change prediction, thereby enabling the painting condition to be more accurately adjusted with less energy.

Further, a tendency of a change in the ambient temperature and a change in the temperature of the resin member painting booth associated with the tendency are learned, the temperature of the resin member painting booth is predicted according to the tendency, and the environmental condition and the painting condition at the time of painting the resin member are determined based on the predicted temperature of the resin member painting booth. By learning the change in the temperature inside the booth associated with the tendency of the change in the ambient temperature, the temperature of the booth can be predicted more accurately. Thus, the painting condition can be adjusted more accurately with less energy consumption.

Further, in the method of painting a vehicle, the color of the steel plate after the painting and the color of the resin member after the painting are estimated based on a future weather change and the change in the temperatures of the steel plate painting booth and the resin member painting booth due to the weather change, and a combination of the temperatures of the steel plate painting booth and the resin member painting booth is determined and the painting condition determined so as to reduce the difference between the color of the steel plate after the painting and the color of the resin member after the painting as a result of the estimation. A combination which consumes the least energy is employed from among the combinations in which the difference between the color of the steel plate and the color of the resin member falls within the predetermined range.

This makes it possible to achieve colors with the minimum energy at that time, instead of having a constant color, and to determine colors with a small color difference. Thus, the painting condition can be adjusted more accurately with less energy consumption.

The vehicle is painted after an administrator evaluates whether the determined environmental condition and the painting condition are appropriate. In this way, the environmental condition and the painting condition can be corrected when they are incorrect.

When the administrator does not perform the evaluation within a predetermined time, the painting is cancelled. This effectively prevents a painting defect when the environmental condition and the painting condition is incorrect.

An example aspect of the present disclosure is a system for painting a vehicle including a first member and a second member which includes a painting surface and which is made of a material different from that of the first member. The system includes a control unit configured to acquire an environmental condition and a painting condition when the first member has been painted, and to determine an environmental condition and a painting condition for the second member, which are determined in advance so that the color of the second member and that of the first member will have the sameness in view of the acquired environmental condition and painting condition for the first member, as the environmental condition and the painting condition at the time of painting the second member which may be used together with the first member. With such a configuration, the environment condition and the painting condition of one of the members are determined based on the environmental condition and the painting condition for the other one of the members, which are determined in advance so that the color of one of the members and that of the other one of the members will have the sameness. By doing so, the adjustment of the environmental conditions and the painting conditions is needed for only one of the members, which reduces the energy consumption.

The system further includes: a storage unit configured to store, when a difference between the color of the first member after the painting and the color of the second member after the painting falls within a predetermined range, the environmental condition and the painting condition at the time of painting the first member in association with the environmental condition and the painting condition at the time of painting the second member. The control unit determines the environmental condition and the painting condition at the time of painting the second member based on the stored environmental condition and the painting condition. With such a configuration, since the determination is made based on the previously stored environmental condition and the painting condition, it is possible to select the condition which causes the smallest color difference.

Further, the first member is a steel plate, the second member is a resin member, the environmental condition at the time of painting the first member includes a temperature of a steel plate painting booth where the steel plate is painted, and the environmental condition at the time of painting the second member includes a temperature of a resin member painting booth where the resin member is painted. With such a configuration, the energy to adjust the painting condition of the booth where small parts such as a bumper are painted is smaller than the energy to adjust the painting condition of the booth where large parts such as a body are painted. Thus, it is possible to reduce the color difference between different members in a manner which consumes less energy.

The environmental condition includes an ambient temperature outside a factory where the resin member painting booth is provided. The temperature of the booth largely influences the color after the painting. The temperature of the booth can be predicted from the ambient temperature. This enables control on the painting condition including a temperature change prediction, thereby enabling the painting condition to be more accurately adjusted with less energy.

The control unit learns a tendency of a change in the ambient temperature and a change in the temperature of the resin member painting booth associated with the tendency. The control unit predicts the temperature of the resin member painting booth according to the tendency. The control unit determines the environmental condition and the painting condition at the time of painting the resin member based on the predicted temperature of the resin member painting booth. By learning the change in the temperature inside the booth associated with the tendency of the change in the ambient temperature, the temperature and humidity of the booth can be predicted more accurately. Thus, the painting condition can be adjusted more accurately with less energy consumption.

In the system, the control unit estimates the color of the steel plate after the painting and the color of the resin member after the painting based on a future weather change and the change in the temperatures of the steel plate painting booth and the resin member painting booth due to the weather change and determines a combination of the temperatures of the steel plate painting booth and the resin member painting booth and the painting condition so as to reduce the difference between the color of the steel plate after the painting and the color of the resin member after the painting as a result of the estimation, and the control unit employs a combination which consumes the least energy from among the combinations in which the difference between the color of the steel plate and the color of the resin member falls within the predetermined range. This makes it possible to achieve colors with the minimum energy at that time, instead of having a constant color, and to determine colors with a small color difference. Thus, the painting condition can be adjusted more accurately with less energy consumption.

The system further includes: a steel plate painting robot configured to paint the steel plate which is the first member; and a resin member painting robot configured to paint the resin member which is the second member. After an evaluation by an administrator that the environmental condition and the painting condition determined by the control unit are appropriate, the control unit controls the steel plate painting robot and the resin member panting robot to paint the vehicle. In this way, the environmental condition and the painting condition can be corrected when they are incorrect.

When the evaluation by the administrator is not input within a predetermined time, the control unit cancels the painting. This effectively prevents a painting defect when the environmental condition and the painting condition is incorrect.

According to the present disclosure, it is possible to provide a painting method and a painting system for vehicles capable of reducing a color difference between different members in a manner which consumes less energy.

The above and other objects, features and advantages of the present disclosure will become more fully understood from the detailed description given hereinbelow and the accompanying drawings which are given by way of illustration only, and thus are not to be considered as limiting the present disclosure.

BRIEF DESCRIPTION OF DRAWINGS

FIG. 4 is a diagram showing an example of explanatory variables including environmental conditions and painting conditions and objective variables including a color difference in the painting system according to the embodiment;

DESCRIPTION OF EMBODIMENTS

Hereinafter, the best mode for carrying out the present disclosure will be described with reference to the attached drawings. However, the present disclosure is not limited to the following embodiment. Further, the following descriptions and the drawings are simplified as appropriate in order to clarify the descriptions.

Embodiment

A painting method and a painting system for vehicles according to an embodiment will be described. First, a configuration of the painting system in a painting factory for painting vehicles will be described. After that, a method of painting a vehicle performed using the painting system will be described.

<Vehicle Painting System>

Figure 1:
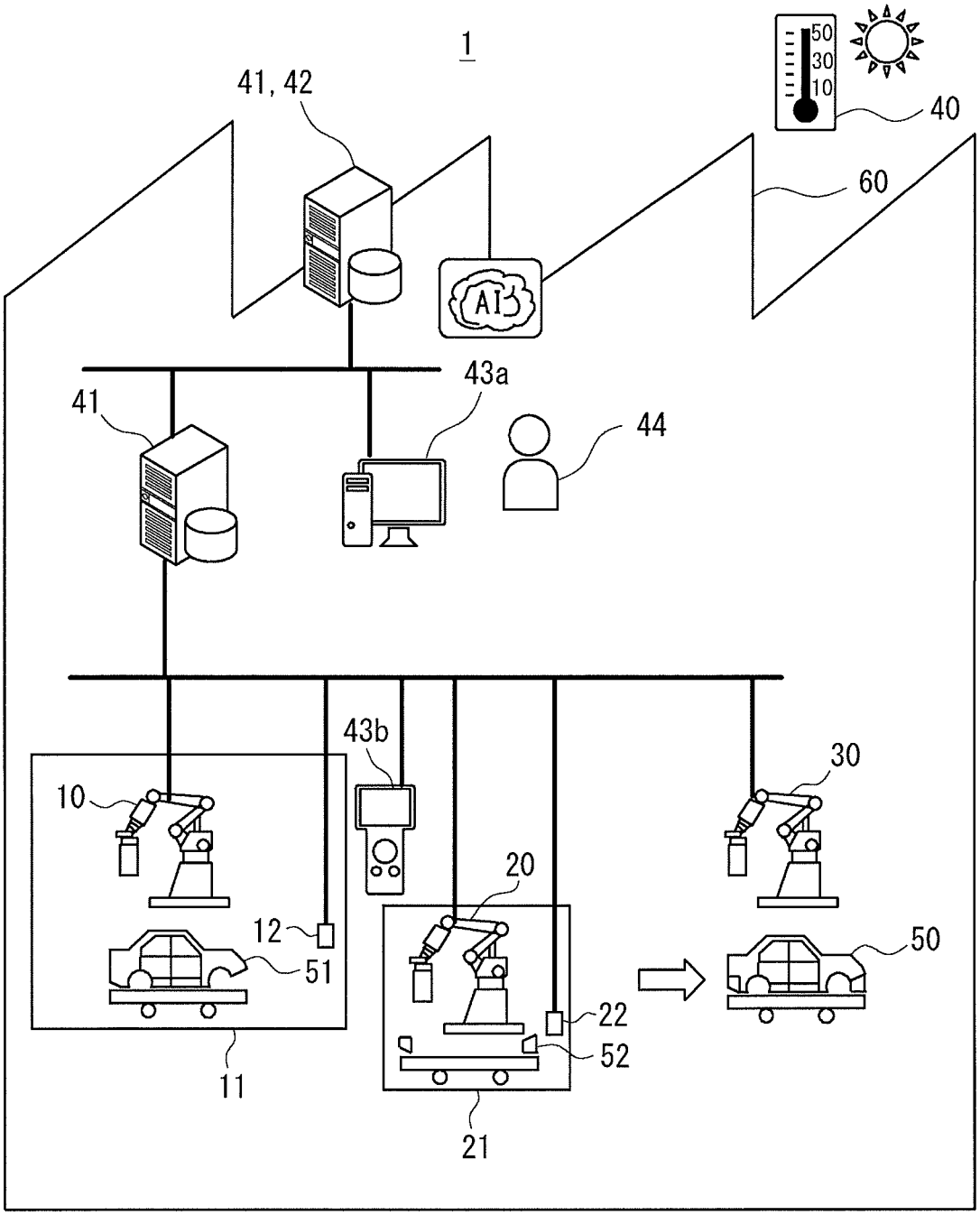
FIG. 1 is a configuration diagram showing an example of a painting system for vehicles according to an embodiment.
Figure 2:
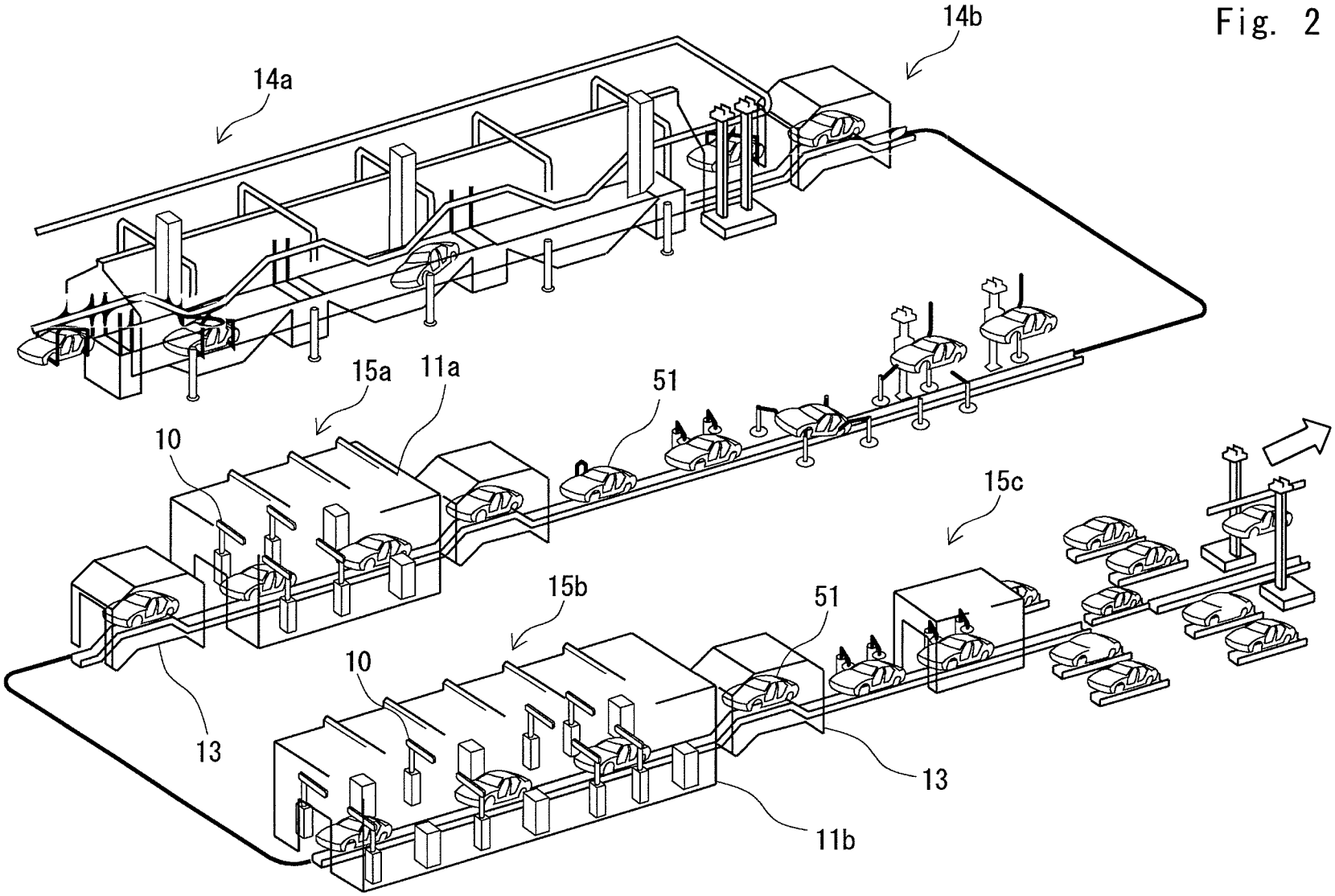
FIG. 2 is a perspective view showing an example of a painting factory provided with a painting system for vehicles according to the embodiment.
Figure 3:
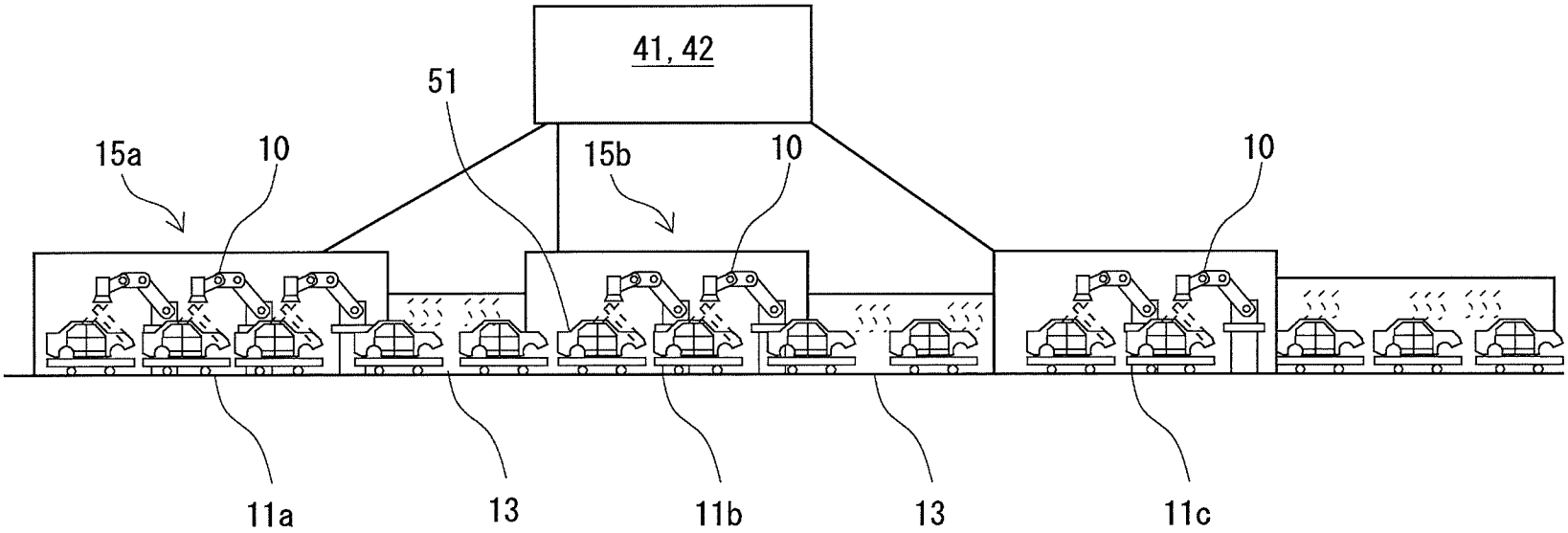
FIG. 3 is a schematic view showing an example of a steel plate painting booth in the painting system for vehicles according to the embodiment.

FIG. 1 is a configuration diagram showing an example of the painting system of a vehicle according to the embodiment. FIG. 2 is a perspective view showing an example of the painting factory provided with the painting system for vehicles according to the embodiment. FIG. 3 is a schematic view showing an example of a steel plate painting booth in the painting system for vehicles according to the embodiment.

As shown in FIGS. 1 to 3, a painting system 1 includes a steel plate painting robot 10, a steel plate painting booth 11, a sensor 12, a resin member painting robot 20, a resin member painting booth 21, a sensor 22, a color measurement robot 30, a sensor 40, a storage unit 41, a control unit 42, and terminal devices 43*a* and 43*b*. Each of these components constituting the painting system 1 is connected by signal lines or signal lines, etc. which transmits information such as radio. The painting system 1 is provided, for example, in a painting factory 60 in which a vehicle 50 is painted. The vehicle 50 includes a steel plate 51 constituting a body and a resin member 52 constituting a bumper. The steel plate 51 contains, for example, a steel material, and the resin member 52 contains a resin material. Thus, one member includes a painting surface made of a material different from that of the other member.

The steel plate painting robot 10, the steel plate painting booth 11, the sensor 12, the resin member painting robot 20, the resin member painting booth 21, and the sensor 22 are disposed inside the painting factory 60. The sensor 40 is disposed outside the painting factory 60. The color measurement robot 30, the storage unit 41, the control unit 42, and the terminal devices 43*a* and 43*b* are disposed inside the painting factory 60.

Note that the painting factory 60 where the vehicle 50 is painted may be separated into a body painting factory and a bumper painting factory. In such a case, the steel plate painting robot 10, the steel plate painting booth 11, and the sensor 12 are disposed inside the body painting factory, and the resin member painting robot 20, the resin member painting booth 21, and the sensor 22 are disposed inside the bumper painting plant. The sensor 40 is disposed outside each factory. The color measurement robot 30, the storage unit 41, the control unit 42, and the terminal devices 43*a* and 43*b* may be disposed in either one of or both of the body painting factory and the bumper painting factory or may be disposed at a place apart from the body painting factory, the bumper painting factory, and the painting factory 60 as long as they are connected to each of the components constituting the painting system 1 by the signal lines, etc.

As shown in FIGS. 2 and 3, the painting process performed by the painting system 1 may include a plurality of processes. For example, the painting process of the steel plate 51 includes a pretreatment process 14*a*, an electrodeposition process 14*b*, an intermediate painting process 15*a*, an overcoat painting process 15*b*, and a wax process 15*c*. The steel plate 51 is conveyed to each process and then painted. Although not shown, the painting process of the resin member 52 may also include processes similar to the above processes, for example, except for the electrodeposition process 14*b*.

FIG. 4 is a diagram showing an example of explanatory variables including environmental conditions and painting conditions and objective variables including a color difference in the painting system according to the embodiment. As shown in FIG. 4, the painting system 1 optimizes the environmental conditions and the painting conditions which are the explanatory variables so as to reduce the color difference between the steel plate 51 and the resin member 52 which are objective variables. The environmental conditions are also referred to as an environmental temperature.

As will be described below, the environmental conditions include temperature and humidity of the steel plate painting booth 11 where the steel plate 51 is painted, temperature and humidity of the resin member painting booth 21 where the resin member 52 is painted, and temperature and humidity of the outside air outside the factory 60 provided with the steel plate painting booth 11 and the resin member painting booth 21, and member temperatures of the steel plate 51 and the resin member 52 at the time of painting.

The painting conditions include a paint temperature, a shaping air (S/A) flow rate for discharging paint, a rotation speed of a bell cup for discharging the paint, a painting current value used for discharging the paint, a discharge amount of the paint, and an inter-robot member distance (robot T value).

As shown in FIG. 1, the steel plate painting robot 10 paints the steel plate 51 such as the body. The steel plate painting robot 10 paints the steel plate 51 according to determined painting conditions.

The steel plate painting booth 11 is a booth where the steel plate 51 is painted. In the steel plate painting booth 11, the steel plate 51 is painted by the steel plate painting robot 10. The steel plate painting booth 11 is a space which can be maintained at a temperature and humidity within a predetermined range. For example, the temperature and humidity of the steel plate painting booth 11 are set by a temperature regulator or the like including a heater and a cooler.

The steel plate painting booth 11 is provided in the intermediate painting process 15*a*, the overcoat painting process 15*b*, and the like in the painting process. For example, as shown in FIGS. 2 and 3, a steel plate painting booth 11*a* is provided in the intermediate painting process 15*a*, and a steel plate painting booth 11*b* is provided in the overcoat painting process 15*b*. The steel plate painting booths 11*a*, 11*b*, 11*c*, and so on are collectively referred to as the steel plate painting booth 11. The steel plate painting booth 11 is a space larger than the resin member painting booth 21. The sensor 12 is disposed in the steel plate painting booth 11. The sensor 12 measures the temperature and humidity inside the steel plate painting booth 11.

Preheat booths 13 are provided between the steel plate painting booths 11*a*, 11*b*, and 11*c*. In the preheat bases 13, the steel plate 51 is set to a predetermined member temperature. The member temperature is measured by a sensor (not shown).

The resin member painting robot 20 paints the resin member 52 such as the bumper. The resin member painting robot 20 paints the resin member 52 according to the determined painting conditions.

The resin member painting booth 21 is a booth where the resin member 52 is painted. In the resin member painting booth 21, the resin member 52 is painted by the resin member painting robot 20. The resin member painting booth 21 is a space that can be maintained at a temperature and humidity within a predetermined range. For example, the temperature and humidity of the resin member painting booth 21 which is the environmental condition is set by a temperature regulator or the like including a heater and a cooler.

Similarly to the steel plate painting booth 11, the resin member painting booth 21 is provided in the intermediate painting process, the overcoat painting process, and the like in the painting process. The resin member painting booth 21 is a space smaller than the steel plate painting booth 11. The resin member painting robot 20 paints the resin member 52 conveyed inside the resin member painting booth 21. The sensor 22 is disposed in the resin member painting booth 21. The sensor 22 measures the temperature and humidity inside the resin member painting booth 21.

Further, a preheat booth is provided between the resin member painting booths 21 in each process. In the preheat booth, the resin member 52 is set to a predetermined member temperature. The member temperature is measured by a sensor (not shown). The sensor 40 provided outside the factory 60 measures the ambient temperature and humidity outside the factory. The sensor 40 may measure an amount of sunlight, an amount of rainfall, a wind direction, a wind speed, and so on which could enable future weather prediction.

The color measurement robot 30 measures the colors of the steel plate 51 and the resin member 52 after the painting. The color after the painting refers to the color of the paint when it is dried after being applied to the steel plate 51 or the resin member 52. The color measurement robot 30 measures the colors of the steel plate 51 and the resin member 52 using an L value, an a value, and a b value which represent luminance and saturation. Further, the color measurement robot 30 measures the colors of the steel plate 51 and the resin member 52 by changing an incident angle and a reflection angle of measurement light. For example, the color measurement robot 30 measures the colors of the steel plate 51 and the resin member 52 using nine parameters combining three items of the Lab values and three measurement light angles (25 [deg], 45 [deg], 75 [deg]).

The storage unit 41 is provided, for example, in a server on a platform. The storage unit 41 of the painting system 1 is not limited to one provided in the server on the platform. Alternatively, the storage unit 41 of the painting system 1 may be provided in a hard disk, a memory, or the like.

The storage unit 41 acquires the environmental conditions from the sensors 12, 22, and 40, etc. via the signal line and the like. The storage unit 41 acquires the painting conditions from the steel plate painting robot 10 and the resin member painting robot 20 via the signal lines, etc. The storage unit 41 acquires the color of the steel plate 51 and the color of the resin member 52 after the painting from the color measurement robot 30 via the signal lines, etc.

The storage unit 41 stores the acquired environmental conditions and painting conditions at the time of painting the steel plate 51, the acquired color of the steel plate 51 after the painting, the acquired environmental conditions and painting conditions at the time of painting the resin member 52, and the acquired color of the resin member 52 after the painting. Thus, the storage unit 41 stores the color of the steel plate 51 after the painting based on the environmental conditions and the painting conditions at the time of painting the steel plate 51, and the color of the resin member 52 after the painting based on the environmental conditions and the painting conditions at the time of painting the resin member 52. The storage unit 41 stores, for example, data in which the environmental conditions and the painting conditions are associated with the color of the steel plate 51 after the painting. The storage unit 41 also stores data in which the environmental conditions and the painting conditions are associated with the color of the resin member 52 after the painting.

When a difference between the color of the steel plate 51 after the painting and that of the resin member 52 after the painting falls within a predetermined range, the storage unit 41 stores the environmental conditions and the painting conditions at the time of painting the steel plate 51 in association with the environment conditions and the painting conditions at the time of painting the resin member 52. By doing so, the storage unit 41 can determine the environmental conditions and the painting conditions for the resin member 52 in view of the environmental conditions and the painting conditions for the steel plate 51 so that the color of the steel plate 51 and that of the resin member 52 will have a sameness. Color with the sameness means colors having a difference within a predetermined range.

The control unit 42 is provided, for example, in the server on the platform. Note that the control unit 42 is not limited to one provided in the server on the platform. For example, the control unit 42 of the painting system 1 may be provided in a PC or a microcomputer.

The control unit 42 acquires the environmental conditions and the painting conditions when the steel plate 51 and the resin member 52 have been painted from the sensor 12 and the like and the steel plate painting robot 10 via the signal lines, etc. The control unit 42 acquires, from the storage unit 41, the color of the steel plate 51 after the painting and the color of the resin member 52 after the painting associated with the environmental conditions and the painting conditions at the time of painting. Further, the control unit 42 calculates the difference between the color of the steel plate 51 and the color of the resin member 52 from the colors measured by the color measurement robot 30. The control unit 42 controls each booth, preheat booth, and painting robot to determine a temperature and humidity of each booth, the member temperatures, and the painting conditions. In this way, the control unit 42 determines and sets the environmental conditions and the painting conditions. Then, the control unit 42 controls the steel plate painting robot 10 and the resin member painting robot 20 to cause the steel plate painting robot 10 and the resin member painting robot 20 to paint the vehicle 50.

An operation of the control unit 42 is described below as an example. Specifically, the control unit 42 determines the environmental conditions and the painting conditions at the time of painting the steel plate 51, and makes adjustments so that they will become the determined conditions. Next, the control unit 42 controls the steel plate painting robot 10 to paint the steel plate 51. The control unit 42 acquires the environmental conditions and the painting conditions when the steel plate 51 has been painted. Next, the control unit 42 acquires the color of the steel plate 51 after the painting from the storage unit 41 based on the environmental conditions and the painting conditions when the steel plate 51 has been painted.

Next, the control unit 42 acquires the color of the resin member 52 having the sameness as that of the acquired color of the steel plate 51 from the storage unit 41. Then, the control unit 42 determines the environmental conditions and the painting conditions when the resin member 52 is painted so that the resin member 52 will be in the color of the acquired resin member 52. That is, the control unit 42 determines the environmental conditions and the painting conditions for the resin member 52, which are determined in advance so that the color of the resin member 52 and the color of the steel plate 51 will have the sameness in view of the environmental conditions and the painting conditions when the acquired steel plate 51 has been painted, as the environmental conditions and the painting conditions when the resin member 52, which may be used together with the steel plate 51, is painted. The control unit 42 controls the resin member painting robot 20 to paint the resin member 52 according to the determined environmental conditions and painting conditions.

In this manner, the control unit 42 determines the environmental conditions and the painting conditions at the time of painting the resin member 52 based on the environmental conditions and the painting conditions when the steel plate 51 has been painted, the stored colors of the steel plate 51 and the resin member 52 after the painting, and the stored environmental conditions and painting conditions.

The energy required to adjust the temperature and humidity of the resin member painting booth 21 is smaller than that of the steel plate painting booth 11, because the resin member painting booth 21 is smaller than the steel plate painting booth 11. Further, the energy required to adjust the member temperature of the resin member 52 and the energy required to adjust the temperature of the paint necessary for painting the resin member 52 are smaller than that of the steel plate 51, because the resin member 52 has a smaller size than the that of the steel plate 51. Therefore, the environmental conditions and the painting conditions at the time of painting the resin member 52 are determined so that the color difference is reduced. Then, the color difference of different members can be reduced in a manner which consumes less energy.

The control unit 42 may acquire, from the storage unit 41, a plurality of pieces of data of the environmental conditions and the painting conditions at the time of painting of the resin member 52 such that the color difference falls within the predetermined range. In such a case, the data which consumes the least energy is selected from among the plurality of pieces of data. For example, if the consumption energy can be reduced by adjusting the painting conditions rather than adjusting the temperature and humidity of the booth, the painting conditions are adjusted.

The control unit 42 learns the tendency of changes in the ambient temperature and humidity, and changes in the temperatures and humidity of the steel plate painting booth 11 and the resin member painting booth 21 associated with the tendency. The control unit 42 predicts the temperatures and humidity of the steel plate painting booth 11 and the resin member painting booth 21 according to the tendency of the changes in the ambient temperature and humidity.

To be more specific, the storage unit 41 acquires the ambient temperature and humidity from the sensor 40, and also acquires the temperatures and humidity of the steel plate painting booth 11 and the resin member painting booth 21 from the sensors 12 and 22. The storage unit 41 acquires, for example, the ambient temperature and humidity, and the temperatures and humidity of the steel plate painting booth 11 and the resin member painting booth 21 at predetermined time intervals. Then, the storage unit 41 stores data of the tendency of the changes in the ambient temperature and humidity, and the changes in the temperature and humidity of the steel plate painting booth 11 and the resin member painting booth 21.

The control unit 42 learns the tendency of the changes in the ambient temperature and humidity stored in the storage unit 41 and the changes in the temperatures and humidity of the steel plate painting booth 11 and the resin member painting booth 21 associated with the tendency. For example, the control unit 42 may include Artificial Intelligence (referred to AI). The AI learns the tendency of the changes in the ambient temperature and humidity stored in the storage unit 41 and the changes in the temperatures and humidity of the steel plate painting booth 11 and the resin member painting booth 21 associated with the tendency. By doing so, when the tendency of the changes in the ambient temperature and humidity is provided, it is possible to predict the temperatures and humidity of the steel plate painting booth 11 and the resin member painting booth 21. As a method of the learning, for example, an algorithm such as a decision tree or random forest may be used, or a mathematical model such as a neural network may be used.

The control unit 42 determines the environmental conditions and the painting conditions at the time of painting the resin member 52 also based on the predicted temperatures and humidity of the steel plate painting booth 11 and the resin member painting booth 21. By doing so, the temperature and humidity of each booth can be predicted more accurately. This effectively prevents sudden temperature adjustment and painting condition changes, thereby enabling the environmental conditions and the painting conditions to be more accurately adjusted with less energy.

Further, the outside environment information other than the temperature and humidity, such as the season and the weather acquired from the sensor 40, may be linked to the tendency of the changes in the ambient temperature and humidity. That is, it is also possible to learn the tendency of the changes in the ambient temperature and humidity corresponding to the outside environment information and the changes in the temperatures and humidity of the steel plate painting booth 11 and the resin member painting booth 21 associated with the tendency. This makes it possible to more accurately predict the temperature and humidity of each booth.

Further, the control unit 42 estimates the color of the painted steel plate 51 after the painting and the color of the resin member 52 after the painting based on the future weather changes and the changes in the temperatures and humidity of the steel plate painting booth 11 and the resin member painting booth 21 due to the weather changes.

For example, the control unit 42 predicts the future weather change from the current ambient temperature and humidity, etc. The control unit 42 also predicts the future changes in the ambient temperature and humidity from the future weather change. The control unit 42 further predicts the changes in the temperature and humidity of the steel plate painting booth 11 and the resin member painting booth 21 due to the weather change. Then, the control unit 42 estimates the color of the steel plate 51 and the color of the resin member 52 after the painting, which are associated with the temperatures and humidity of the steel plate painting booth 11 and the resin member painting booth 21 expected in the future. The control unit 42 may control the AI to make such an estimation.

As a result of the estimation, the control unit 42 determines the combination of the temperatures and humidity of the steel plate painting booth 11 and the resin member painting booth 21 and the painting conditions so as to reduce the difference between the color of the steel plate 51 and the color of the resin member 52. Specifically, the control unit 42 derives combinations of the temperatures and humidity of the steel plate painting booth 11 and the resin member painting booth 21 and the painting conditions so as to reduce the difference between the estimated color of the steel plate 51 after painting and the estimated color of the resin member 52. A plurality of combinations of the temperature and humidity and the painting conditions of the steel plate painting booth 11 and the resin member painting booth 21 and the painting conditions which can reduce the difference between the colors of the steel plate 51 and the resin member 52 are derived.

Then, the control unit 42 employs the combination which consumes the least energy from among the combinations in which the difference between the color of the steel plate 51 and the color of the resin member 52 falls within the predetermined range. That is, the control unit 42 employs the combination which consumes the least energy from among the derived combinations of the temperatures and humidity of the steel plate painting booth 11 and resin member painting booth 21 and the painting conditions. The energy consumption includes, for example, energy to adjust each booth to a predetermined temperature and humidity, energy to adjust each member to a predetermined member temperature, and energy to adjust a paint to a set paint temperature.

The terminal devices 43*a* and 43*b* are, for example, OA personal computers. The terminal devices 43*a* and 43*b* display the environmental conditions from the sensor 12 and the like, and the painting conditions from the steel plate painting robot 10 and the like. This enables an administrator 44 to know the environmental conditions and the painting conditions. Thus, the administrator 44 can manage an operation status of the painting system 1.

The administrator 44 may evaluate whether the environmental conditions and the painting conditions determined by the control unit 42 are appropriate. After the administrator 44 determines that the conditions are appropriate, that is, after the evaluation of the administrator that the environmental conditions and the painting conditions determined by the control unit 42 are appropriate is input, the control unit 42 controls the steel plate painting robot 10 and the resin member painting robot 20 to paint the vehicle 50. In this way, the determination can be corrected when the determination of the control unit 42 is incorrect.

On the other hand, when the administrator 44 does not evaluate whether the determination is appropriate within a predetermined time, that is, when the evaluation by the administrator 44 is not input within the predetermined time, the control unit 42 may perform control to cancel the painting of the vehicle 50. This effectively prevents a painting defect when the determination of the control unit 42 is incorrect.

<Method of Painting Vehicle>

Figure 5:
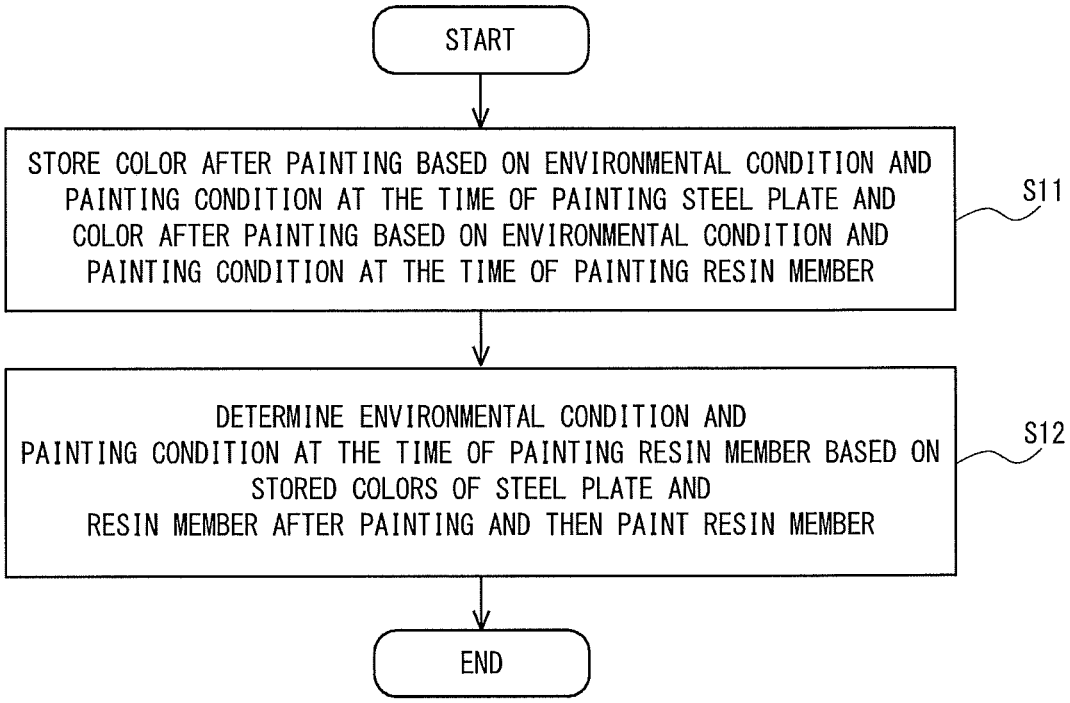
FIG. 5 is a flowchart showing an example of a method of painting a vehicle according to the embodiment.
Figure 6:
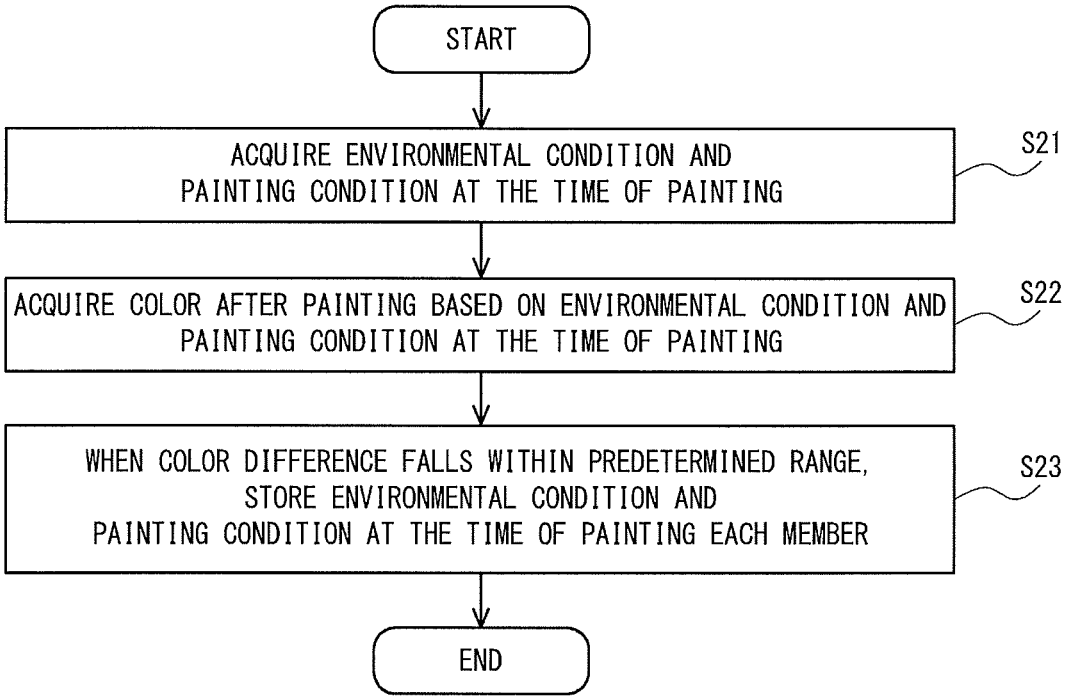
FIG. 6 is a flowchart showing an example of steps of storing colors based on the environmental conditions and the painting conditions in the method of painting a vehicle according to the embodiment.
Figure 7:
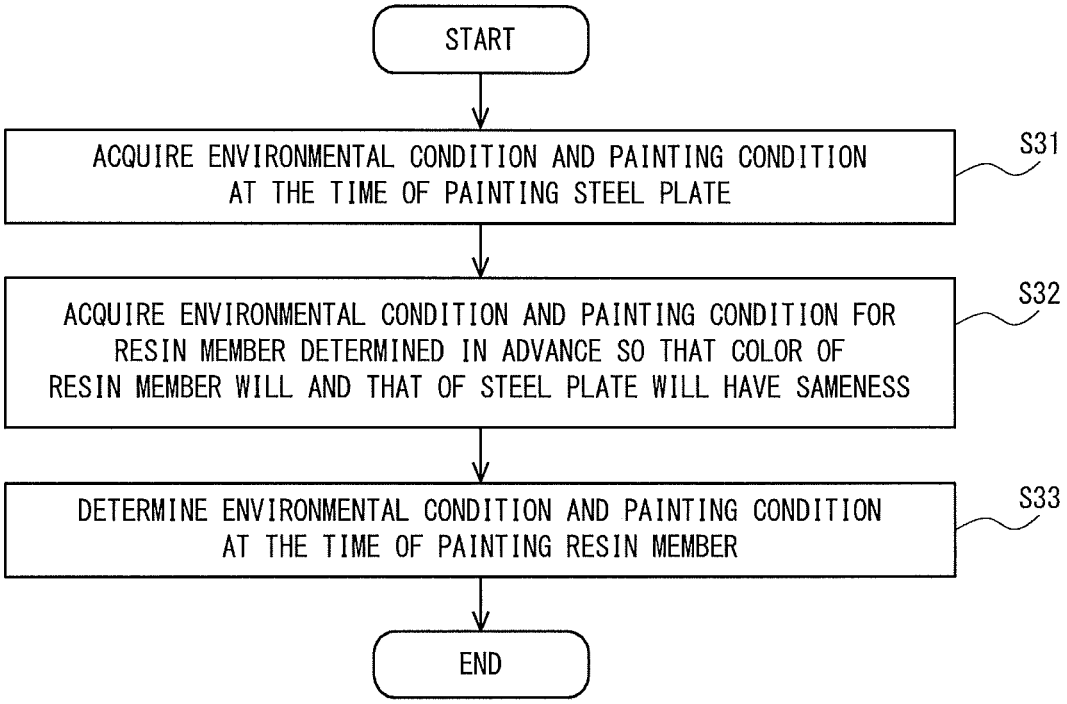
FIG. 7 is a flowchart showing an example of steps of determining the environmental conditions and the painting conditions in the method of painting a vehicle according to the embodiment.

Next, a method of painting a vehicle according to the embodiment will be described. FIG. 5 is a flowchart showing an example of the method of painting a vehicle according to the embodiment. FIG. 6 is a flowchart showing an example of steps of storing the color based on the environmental conditions and the painting conditions in the method of painting the vehicle according to the embodiment. FIG. 7 is a flowchart showing an example of steps of determining the environmental conditions and the painting conditions in the method of painting the vehicle according to the embodiment.

As shown in Step S11 of FIG. 5, for example, the color of the steel plate 51 after the painting based on the environmental conditions and the painting conditions at the time of painting the steel plate 51, and the color of the resin member 52 after the painting based on the environmental conditions and the painting conditions at the time of painting the resin member 52 are stored.

When the color after the painting based on the environmental conditions and the painting conditions of each member is stored, as shown in Step S21 of FIG. 6, firstly the environmental conditions and the painting conditions at the time of painting are acquired. Specifically, the storage unit 41 acquires the environmental conditions including the temperature and humidity of the steel plate painting booth 11 measured by the sensor 12, the temperature and humidity of the resin member painting booth 21 measured by the sensor 22, the ambient temperature and humidity measured by the sensor 40, and the member temperature measured by the sensor (not shown). The storage unit 41 acquires these environmental conditions from the sensor 12 and the like via the signal lines, etc. The storage unit 41 acquires the painting conditions of the steel plate painting robot 10 and the resin member painting robot 20.

Next, as shown in Step S22, the color after the painting based on the environmental conditions and the painting conditions at the time of painting is acquired. Specifically, the storage unit 41 acquires the colors of the steel plate 51 and the resin member 52 after the painting measured by the color measurement robot 30. The storage unit 41 acquires the colors of the steel plate 51 and the resin member 52 after the painting from the color measurement robot 30 via the signal lines, etc.

Next, as shown in Step S23, when the difference between the color of the steel plate 51 and the color of the resin member 52 after the painting falls within the predetermined range, the environmental conditions and the painting conditions at the time of painting the steel plate 51 are stored in association with the environmental conditions and the painting conditions at the time of painting the resin member 52. That is, the storage unit 41 stores data in which the color of the steel plate 51 after the painting and the color of the resin member 52 after the painting associated with environmental conditions and the painting conditions. It is desirable that the storage unit 41 store a plurality of pieces of such data.

As described above, when the difference between the color of the steel plate 51 and the color of the resin member 52 after the painting falls within the predetermined range, the storage unit 41 previously stores the environmental conditions and the painting conditions at the time of painting the steel plate 51 in association with the environmental conditions and the painting conditions at the time of painting the resin member 52.

Next, as shown in Step S12 of FIG. 5, the environmental conditions and the painting conditions at the time of painting the resin member 52 are determined based on the environmental conditions and painting conditions when the steel plate 51 has been painted, and the stored colors of the steel plate 51 and the resin member 52 after the painting, and then the resin member 52 is painted.

When the environmental conditions and the painting conditions at the time of painting the resin member 52 are determined, as shown in Step S31 of FIG. 7, the environmental conditions and the painting conditions when the steel plate 51 has been painted are acquired. Specifically, the control unit 42 acquires the environmental conditions when the steel plate 51 has been painted from the sensor 12 or the like via the signal line, etc. Further, the control unit 42 acquires the painting conditions when the steel plate 51 has been painted from the steel plate painting robot 10 via the signal line, etc. Then, the control unit 42 acquires, from the storage unit 41, the color of the steel plate 51 associated with the acquired environmental conditions and painting conditions.

Next, as shown in Step S32, the environmental conditions and the painting conditions for the resin member 52, which are determined in advance so that the color of the resin member 52 and that of the steel plate 51 will have the sameness in view of the environmental conditions and the painting conditions for the acquired color of the steel plate 51, are acquired. Specifically, the control unit 42 acquires, from the storage unit 41, the color of the resin member 52 after the painting which differs from the acquired color of the steel plate 51 by the predetermined range or less. In this way, the control unit 42 acquires the environmental conditions and the painting conditions associated with the acquired color of the resin member 52. It is desirable that the control unit 42 acquire the plurality of environmental conditions and the plurality of painting conditions associated with the acquired color of the resin member 52. By doing so, the control unit 42 can select the environmental conditions and the painting conditions which consume the least energy from among the plurality of environmental conditions and the plurality of painting conditions.

Next, as shown in Step S33, the environmental conditions and the painting conditions at the time of painting the resin member 52 are determined. Specifically, the environmental conditions and the painting conditions for the acquired resin member 52 are determined as the environmental conditions and the painting conditions when the resin member 52 which may be used together with the steel plate 51 is painted.

As described above, the control unit 42 determines the environmental conditions and the painting conditions at the time of painting the resin member 52 based on the environmental conditions and the painting conditions stored in the storage unit 41. Then, the resin member 52 is painted according to the determination.

Here, when the environmental conditions and the painting conditions at the time of painting the resin member 52 are determined, the tendency of the changes in the ambient temperature and humidity and the changes in the temperatures and humidity of the steel plate painting booth 11 and the resin member painting booth 21 associated with the tendency may be learned, and the temperatures and humidity of the steel plate painting booth 11 and the resin member painting booth 21 may be predicted according to the tendency of the changes in the ambient temperature and humidity.

Specifically, firstly the storage unit 41 acquires the ambient temperature and humidity from the sensor 40 in order to control the AI of the control unit 42 to learn it. The outside environment information other than the temperature and humidity, such as the season and the weather acquired from the sensor 40, may be linked to the tendency of the changes in the ambient temperature and humidity. The control unit 42 also acquires the temperatures and humidity of the steel plate painting booth 11 and the resin member painting booth 21 from the sensors 12 and 22.

The AI of the control unit 42 learns the tendency of the changes in the ambient temperature and humidity stored in the storage unit 41 and the changes in the temperatures and humidity of the steel plate painting booth 11 and the resin member painting booth 21 associated with the tendency. Note that the AI of the control unit 42 may learn, in real time instead of using the storage unit 41, the tendency of the changes in the ambient temperature and humidity and the changes in the temperatures and humidity of the steel plate painting booth 11 and the resin member painting booth 21 associated with the tendency. Further, the AI of the control unit 42 may learn the tendency of the changes in the ambient temperature and humidity corresponding to the outside environment information and the changes in the temperatures and the humidity of the steel plate painting booth 11 and the resin member painting booth 21 associated with the tendency.

Then, the control unit 42 may determine the environmental conditions and the painting conditions at the time of painting the resin member 52 also based on the predicted temperatures and humidity of the steel plate painting booth 11 and the resin member painting booth 21.

Such learning enables the AI of the control unit 42 to predict the temperatures and humidity of the steel plate painting booth 11 and the resin member painting booth 21 when it is provided with the ambient temperature and humidity. As described above, by predicting the changes in the temperatures and humidity of the steel plate painting booth 11 and the resin member painting booth 21 based on the tendency of the changes in the ambient temperature and humidity, it is possible to effectively prevent sudden temperature adjustment and changes in the painting conditions, thereby enabling adjustments of the painting conditions with less energy and more accuracy.

Further, when the steel plate 51 and the resin member 52 are painted, the color of the steel plate 51 after the painting and the color of the resin member 52 after the painting may be estimated based on the future weather change and the changes in the temperatures and humidity of the steel plate painting booth 11 and the resin member painting booth 21 due to the weather change.

For example, the AI of the control unit 42 predicts the future weather change from the current ambient temperature and humidity. The AI of the control unit 42 further predicts the future changes in the ambient temperature and humidity from the future weather change. Furthermore, the AI of the control unit 42 predicts the change in the temperatures and humidity of the steel plate painting booth 11 and the resin member painting booth 21 due to the weather change. Then, the AI of the control unit 42 estimates the color of the steel plate 51 after the painting and the color of the resin member 52 after the painting due to the future change in the temperatures and humidity of the steel plate painting booth 11 and the resin member painting booth 21.

As a result of the estimation, the combination of the temperatures and humidity of the steel plate painting booth 11 and the resin member painting booth 21 and the painting conditions is determined so as to reduce the difference between the color of the steel plate 51 and the color of the resin member 52. Specifically, the AI of the control unit 42 derives the combinations of the temperatures and humidity of the steel plate painting booth 11 and the resin member painting booth 21 and the painting conditions so as to reduce the difference between the estimated color of the steel plate 51 after the painting and the estimated color of the resin member 52 after the painting. Then, the AI of the control unit 42 employs the combination which consumes the least energy from among the combinations in which the difference between the color of the steel plate 51 and the color of the resin member 52 falls within the predetermined range and then performs the painting.

For example, the steel plate painting booth 11 is larger than the resin member painting booth 21. Thus, the energy required to adjust the temperature and humidity of the resin member painting booth 21 is smaller than the energy required to adjust the temperature and humidity of the steel plate painting booth 11. Therefore, as an example, the temperature and humidity of the resin member painting booth 21 are adjusted so that the difference between the color of the steel plate 51 and the color of the resin member 52 falls within the predetermined range. Then, the painting can be performed using the method which consumes the least energy.

Note that the vehicle may be painted after the administrator evaluates whether the determined environmental conditions and painting conditions are appropriate. In this way, the determination can be corrected when the determination of the control unit 42 is incorrect. On the other hand, when the administrator does not make the evaluation within the predetermined time, the painting is cancelled. This effectively prevents a painting defect when the determination of the control unit 42 is incorrect.

Next, the effects of the painting system and method of painting a vehicle according to the embodiment will be described.

In this embodiment, when the steel plate 51 and the resin member 52 are painted, the environment conditions and the painting conditions for one of the steel plate 51 and the resin member 52 are determined based on the environmental conditions and the painting conditions for the other one of the steel plate 51 and the resin member 52 determined in advance so that the color of the steel plate 51 and that of the resin member 52 will have the sameness. By doing so, the adjustment of the environmental conditions and the painting conditions is needed for only one of the steel plate 51 and the resin member 52, which reduces the energy consumption Moreover, the color after the painting based on the environmental conditions and the painting conditions at the time of painting is stored for each member. Then, the color of each member after the painting can be estimated from the environmental conditions and the painting conditions at the time of painting. By determining the environmental conditions and the painting conditions at the time of painting, it is possible to reduce the difference in the colors of the members after the painting.

The steel plate painting booth 11 for painting large members such as the steel plate 51 constituting the body or the like is larger than the resin member painting booth 21 for painting small members such as the resin member 52 constituting the bumper or the like. For this reason, the energy required to adjust the painting conditions of the resin member painting booth 21 is smaller than the energy required to adjust the painting conditions of the steel plate painting booth 11. In this embodiment, the environmental conditions and the painting conditions at the time of painting the resin member 52 are determined based on the environmental conditions and the painting conditions when the steel plate 51 has been painted. Thus, the color difference of different members can be reduced in a manner which consumes less energy.

The temperatures of the steel plate painting booth 11 and the resin member painting booth 21 largely influences the color after the painting. Such a temperature of each booth can be predicted from the ambient temperature and humidity. Thus, the temperature and humidity of each booth and the ambient temperature and humidity are included in the environmental conditions stored in association with the color of each member after the painting. In this way, the environmental conditions and the painting conditions including the temperature change prediction can be controlled. Moreover, the energy can be saved while accurately associating the environmental conditions and the painting conditions with the color after the painting.

In this embodiment, the outside environment information other than the temperature such as the season and the weather is linked to the tendency of changes in the ambient temperature and humidity, and further, the change in the temperature and humidity in the booth associated with the changes in the ambient temperature and humidity is learned. This enables the temperatures and humidity of the booths to be predicted more accurately. Thus, the painting conditions can be adjusted more accurately with less energy consumption.

Furthermore, in this embodiment, the combination of the temperatures and humidity of the steel plate painting booth 11 and the resin member painting booth 21 and the painting conditions is determined so as to reduce the difference between the color of the steel plate 51 and the color of the resin member 52. This makes it possible to achieve colors with the minimum energy at that time, instead of having a constant color, and to determine colors with a small color difference. Thus, the painting conditions can be adjusted more accurately with less energy consumption.

The difference between the color of the steel plate 51 and the color of the resin member 52 may be reduced if the environmental conditions and the painting conditions are made completely constant without concerning about the energy cost and the like. However, when there are changes in the outside air or seasonal variations within a day, such a method could increase the energy consumption.

This embodiment can reduce the energy consumption, because the changes in the outside air and seasonal variations within a day are predicted, and the conditions are determined in a manner which consumes the least energy at that time. Further, the plurality of sensors are provided to acquire the environmental conditions and the like. Then, big data analysis can be performed by the AI, thereby enabling optimization of the environmental conditions and painting conditions.

The embodiment according to the present disclosure has been described so far. However, the present disclosure is not limited to the above configuration, and modifications can be made without departing from the technical concept of the present disclosure.

For example, instead of the control unit 42, the administrator 44 may determine the environmental conditions and the painting conditions. That is, for example, the administrator 44 may acquire the environmental conditions and the painting conditions when the steel plate 51 has been painted, and determine the environmental conditions and the painting conditions for the resin member 52, which are determined in advance so that the color of the resin member 52 and that of the steel plate 51 will have the sameness in view of the environmental conditions and the painting conditions for the acquired steel plate 51, as the environmental conditions and the painting conditions when the resin member 52, which may be used together with the steel plate 51, is painted.

Further, the following matters are also within the scope of the technical concept of this embodiment.

A method of painting a vehicle including a steel plate and a resin member, the method comprising:

storing a color of the steel plate after painting based on an environmental temperature and a paint temperature at the time of the painting and a color of the resin member after the painting based on the environmental temperature and the paint temperature at the time of painting the resin member; and determining the environmental temperature and the paint temperature at the time of painting the resin member based on the environmental temperature and the paint temperature when the steel plate has been painted.

A system for painting a vehicle including a steel plate and a resin member, the system comprising:

a storage unit configured to store a color of the steel plate after painting based on an environmental temperature and a paint temperature at the time of the painting and a color of the resin member after the painting based on the environmental temperature and the paint temperature at the time of painting the resin member; and a control unit configured to determine the environmental temperature and the paint temperature at the time of painting the resin member based on the environmental temperature and the paint temperature when the steel plate has been painted.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A method of painting a vehicle comprising a first member and a second member which includes a painting surface and which is made of a material different from that of the first member, the method comprising:

acquiring a first environmental condition and a first painting condition when the first member has been painted, wherein the first environmental condition includes a temperature and a humidity of a first member painting booth, and the first painting condition includes at least one of a paint temperature, a shaping air flow rate for discharging paint, a rotation speed of a bell cup for discharging the paint, a painting current value used for discharging the paint, a discharge amount of the paint, and an inter-robot member distance; and determining a second environmental condition and a second painting condition for the second member, which are determined in advance so that a color of the second member and a color of the first member will have colors having a small color difference and a similarity to a single color based on the acquired first environmental condition and the first painting condition for the first member, wherein the second environmental condition includes a temperature and a humidity of a second member painting booth;

determining a first amount of energy to be consumed by adjusting the second environmental condition and a second amount of energy to be consumed by adjusting the second painting condition;

adjusting only the second environmental condition when the first amount of energy is less than the second amount of energy; and adjusting only the second painting condition when the second amount of energy is less than the first amount of energy.

2. The method according to claim 1, wherein when a difference between the color of the first member after the painting and the color of the second member after the painting falls within a predetermined range, the first environmental condition and the first painting condition at the time of painting the first member are stored in association with the second environmental condition and the second painting condition at the time of painting the second member, and the second environmental condition and the second painting condition at the time of painting the second member are determined based on the stored first environmental condition and the first painting condition.

3. The method according to claim 1, wherein the first member is a steel plate, and the second member is a resin member.

4. The method according to claim 3, wherein the second environmental condition includes an ambient temperature outside a factory where the resin member painting booth is provided.

5. The method according to claim 4, wherein a tendency of a change in the ambient temperature and a change in the temperature of the resin member painting booth associated with the tendency are learned;

the temperature of the resin member painting booth is predicted according to the tendency, and the second environmental condition and the second painting condition at the time of painting the resin member are determined based on the predicted temperature of the resin member painting booth.

6. The method according to claim 4, further comprising:

estimating the color of the steel plate after the painting and the color of the resin member after the painting based on a future weather change and the change in the temperatures of the steel plate painting booth and the resin member painting booth due to the weather change; and determining a combination of the temperatures of the steel plate painting booth and the resin member painting booth and the second painting condition so as to reduce the difference between the color of the steel plate after the painting and the color of the resin member after the painting as a result of the estimation, wherein a combination which consumes the least energy is employed from among the combinations in which the difference between the color of the steel plate and the color of the resin member falls within the predetermined range.

7. The method according to claim 1, wherein the vehicle is painted after an administrator evaluates whether the determined second environmental condition and second painting condition are appropriate.

8. The method according to claim 7, wherein when the administrator does not perform the evaluation within a predetermined time, the painting is cancelled.

9. The method according to claim 1, wherein the first environmental condition further includes a temperature of the first member at a time of painting the first member;

the second environmental condition further includes a temperature of the second member at a time of painting the second member.

10. The method according to claim 1, wherein the first painting condition includes the paint temperature, the shaping air flow rate for discharging paint, the rotation speed of a bell cup for discharging the paint, the painting current value used for discharging the paint, the discharge amount of the paint, and the inter-robot member distance.

* * * * *